US010440477B2

(12) United States Patent
Bollini

(10) Patent No.: US 10,440,477 B2
(45) Date of Patent: Oct. 8, 2019

(54) METHOD AND APPARATUS FOR PLAYING AUDIO BY MEANS OF PLANAR ACCOUSTIC TRANSDUCERS

(71) Applicant: GLAUK S.R.L., Florence (IT)

(72) Inventor: Alessandro Bollini, Montespertoli (IT)

(73) Assignee: GLAUK S.R.L., Florence (IT)

( * ) Notice: Subject to any disclaimer, the term of this patent is extended or adjusted under 35 U.S.C. 154(b) by 0 days.

(21) Appl. No.: 16/071,676

(22) PCT Filed: Jan. 22, 2016

(86) PCT No.: PCT/IB2016/050334
§ 371 (c)(1),
(2) Date: Jul. 20, 2018

(87) PCT Pub. No.: WO2017/125789
PCT Pub. Date: Jul. 27, 2017

(65) Prior Publication Data
US 2019/0037315 A1 Jan. 31, 2019

(51) Int. Cl.
*H04R 7/04* (2006.01)
*H04R 1/24* (2006.01)
*H04R 3/14* (2006.01)

(52) U.S. Cl.
CPC ..... *H04R 7/045* (2013.01); *H04R 1/24* (2013.01); *H04R 3/14* (2013.01); *H04R 2201/021* (2013.01)

(58) Field of Classification Search
CPC . H04R 7/045; H04R 1/24; H04R 3/14; H04R 2201/021
USPC ..... 381/98, 111
See application file for complete search history.

(56) References Cited

U.S. PATENT DOCUMENTS

| | | | | |
|---|---|---|---|---|
| 6,170,603 | B1 | 1/2001 | Bachmann et al. | |
| 7,650,003 | B1 * | 1/2010 | Hines | H04R 7/045 381/152 |
| 8,085,971 | B2 * | 12/2011 | Kam | H04R 9/043 181/171 |
| 8,422,721 | B2 * | 4/2013 | Rizzello | H04R 1/26 381/182 |
| 8,879,766 | B1 * | 11/2014 | Zhang | H04R 1/028 381/333 |
| 2010/0086151 | A1 * | 4/2010 | Ruiter | H04R 17/00 381/190 |

FOREIGN PATENT DOCUMENTS

| | | | |
|---|---|---|---|
| EP | 0969691 | A1 | 1/2000 |
| WO | 2002063919 | A2 | 8/2002 |

OTHER PUBLICATIONS

International Preliminary Report on Patentability (IPRP) for Appl. No. PCT/IB2016/050334 by The International Bureau of WIPO, dated Apr. 25, 2018.
International Search Report and Written Opinion for PCT/IB2016/050334 by the EPO, dated Jul. 27, 2016.

* cited by examiner

*Primary Examiner* — David L Ton
(74) *Attorney, Agent, or Firm* — Abelman, Frayne & Schwab

(57) ABSTRACT

Apparatus and method for playing music by means of planar acoustic transducers adapted to optimize the music emission quality.

12 Claims, 5 Drawing Sheets

METHOD AND APPARATUS FOR PLAYING AUDIO BY MEANS OF PLANAR ACCOUSTIC TRANSDUCERS

FIELD OF THE INVENTION

The present invention relates to the technical field of acoustic speakers, and in particular to the technical field of acoustic speakers made with planar acoustic transducers.

BACKGROUND ART

So-called planar acoustic transducers are known in the art. Said planar acoustic transducers have many advantages and benefits with respect to the traditional speakers commonly known as cone or horn speakers.

Indeed, traditional acoustic speakers of the cone type emit spherical-type pressure waves which propagate from a point in all directions, are attenuated proportionally to the square of the distance from the emission point and, as they propagate in all directions, are subject to undergo several reflections before reaching the user's auditory apparatus, which reflections cause distortions of various type which afflict, and are to the detriment, of the carried content, music, voice etc.

Instead, planar acoustic transducers emit planar-type pressure waves, which propagate in a single direction, are attenuated proportionally to the distance from the emission point and are not subject, by propagating in a single direction, to undergo reflections before reaching the user's auditory apparatus, thus achieving to deliver audio content which is substantially intact and only minimally distorted with respect to the original.

In addition to this, traditional acoustic cone speakers are bulkier and heavier, have much longer response time and higher final use costs considering that about three times more traditional speakers than planar acoustic transducers are needed, the surface to be covered being equal.

Finally, unlike traditional acoustic speakers, planar acoustic transducers do not need air as propagation medium of the acoustic content and this allows sound to be played also in environments and in situations in which traditional acoustic speakers cannot be used or installed, e.g. such as on the surfaces of walls, ceilings, floors, furniture items etc. It is apparent that the techniques of installing planar acoustic transducers are different from those for traditional acoustic speakers and that the mutual arrangement of the various transducers on the installation support is fundamental for the resulting music emission quality.

The present invention thus relates to an apparatus and method for music diffusion by means of planar acoustic transducers adapted to optimize the musical emission quality.

BRIEF DESCRIPTION OF THE DRAWINGS

Further objects, features and advantages of the present invention will become more apparent from the following detailed description provided by way of a non-limitative example and shown in the accompanying drawings, in which.

DETAILED DESCRIPTION OF THE INVENTION

Figure 1:
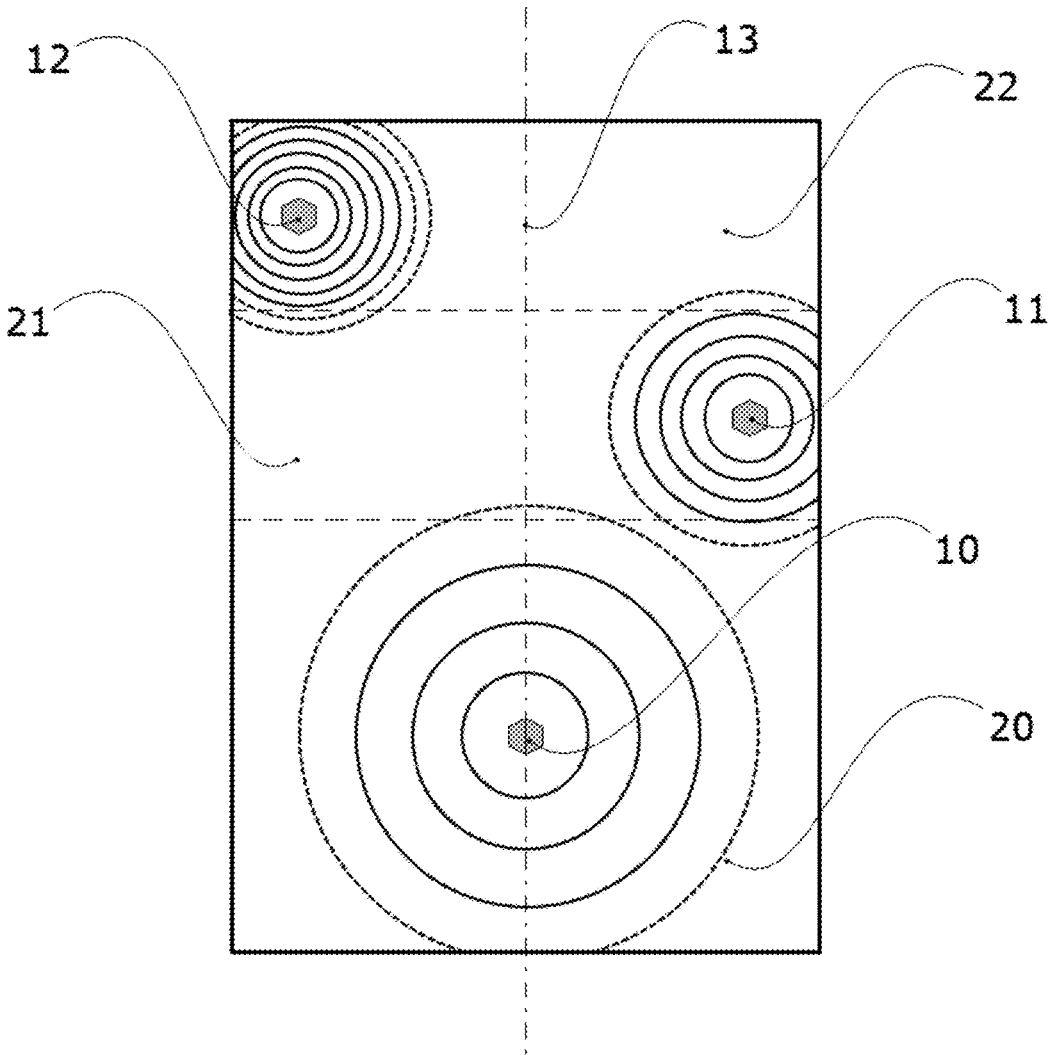
FIG. 1 shows a first preferred embodiment of the apparatus for playing audio according to the present invention.

It is the main object of the present invention to provide an apparatus and method for playing music by means of planar acoustic transducers adapted to optimize emission quality.

Sound is produced by a pressure variation which propagates in an elastic physical medium, such as air, water, wood and innumerable others. The propagation of an acoustic wave is an energy carrying mechanism which occurs by means of acoustic waves which appears as successions of compressions and rarefactions of the medium; the acoustic signal and its propagation is thus always associated with pressure variations in the carrying medium.

The propagation speed c [m/s] depends on the features of the medium in which these pressure variations occur. In a fluid medium, for example, the sound propagation speed is defined by the formula: $c=\sqrt{K/\rho}$, where K is the bulk modulus and $\rho$ is the medium density.

The bulk modulus, measured in Pascal, indicates the capacity of materials to withstand uniform compression forces and quantifies the movement of an atom (or of a molecule) influences that of the adjacent atoms (or molecules). In general, regardless of the propagation medium of the acoustic waves, an optimal trade-off must always be achieved between acoustic efficiency and deformation resistance of the medium.

The band extension to the audio frequencies audible by humans extends approximately from 20 Hz to 20 kHz. It generally occurs that the frequency band effectively reproduced by a single speaker, the so-called useful band, is not sufficiently broad to cover the entire audible spectrum. Indeed, the directionality of a single speaker varies with the frequency and the maximum acoustic power generated by a speaker is averagely insufficient if exploited on a wide band of the spectrum. For this reason, the speaker systems are generally classified as a function of the number of bands into which the audible spectrum is divided to ensure a reproduction which is as faithful as possible. Indeed, before being fed to the speakers in the system, the signal is divided into bands by using a series of filters, named crossovers.

In the field of traditional acoustic speakers, the audio signal playing is optimized by dividing the sound frequency band usually into three sub-bands, corresponding to the low, medium and high frequency. This allows acoustic speakers adapted to work with a well-defined, limited frequency band to be used, as there is no traditional type speaker conveniently capable of playing the entire range of perceivable sounds, i.e. without displaying limits in terms of dispersion, distortion etc. As mentioned, this is true because traditional auditory speakers are made according to a construction technique which makes them specifically suited for a given frequency band and not suited to transduce input signal components having a frequency outside the nominal range.

Appropriate separator filters or crossovers are used upstream of the speakers to perform the aforesaid division of the audio frequency band so as to separate the various frequency bands of the electric signal which is then sent to the speakers to be converted into acoustic signal and for the subsequent reproduction.

A typical crossover for speakers is made by a network of filters (low-pass, high-pass, band-pass) consisting of capacitors and inductors adapted to divide the spectrum of the electric signal into distinct frequency bands. Each of the electric signals output by the crossover, comprising the audio content related to a single frequency band, is sent to a speaker or to a group of speakers of the employed speaker system.

The fundamental parameters of a crossover filter are the cutoff (or crossover) frequency and the slope representing how sharp is the cutoff of the frequencies external to the filter itself.

The simplest crossover consists of a low-pass filter and a high-pass filter arranged so as to send their output signals to the speakers for the low band of the spectrum and for the high band of the spectrum of a two-way system.

A typical example of crossover employed with traditional two-way speakers has a single cutoff frequency at 3500 Hz so that frequencies lower than 3500 Hz are sent to the woofer (the speaker for the lower frequency sounds), while frequencies higher than 3500 Hz are sent to the tweeter (the speaker for the higher frequency sounds). The aforesaid separator filters or crossovers can also be used in the field of planar speakers although with different cutoff frequency choices. Indeed, in the field of planar speakers, crossovers having frequency bands which are partially overlapped are often used, given the difference of the medium in which the sound waves must propagate.

Indeed, planar acoustic transducers—or speakers—are substantially full range speakers with regards to the audio frequencies compatible with their structure. Indeed, the useful band of said planar acoustic transducers normally extends from 100 Hz to 20 kHz, thus the response of the material on which the planar acoustic transducer is applied will have a greater audible spectrum. Furthermore, unlike traditional speakers, the directionality in planar acoustic transducers does not vary as a function of the frequency, because the sound waves are uniformly propagated on the entire surface of the material on which said planar acoustic transducers are installed.

This clearly allows greater freedom with respect to traditional auditory speakers for choosing and using possible crossover filters. The present invention thus suggests a new method for using and positioning planar acoustic speakers in connection to the use of appropriate crossover filters.

Different installation and positioning methods of the planar acoustic speakers must be provided as the sound transmission dynamics in planar acoustic speakers follows different methods with respect to the sound transmission in volumes filled with air, typical of the traditional auditory speakers.

As described above, the sound emitted by the planar acoustic transducers propagates on a surface by means of pressure waves characterized by frequency and wavelength exactly as the pressure waves emitted by traditional speakers, which are propagated in air. Therefore, in general terms, the method according to the present invention provides for:

- choosing appropriate crossover filters adapted to divide the audible frequency band 20 Hz-20 kHz into at least two frequency sub-bands;
- choosing an appropriate number of planar acoustic transducers compatible with said at least two frequency sub-bands;
- dividing the available surface for installing the aforesaid planar acoustic transducers into zones each dedicated to the installation of at least one of the aforesaid planar acoustic transducers;
- choosing the positioning point of each of said at least one planar acoustic transducer.

The sequence of the above-listed operations is adapted to install a plurality of planar acoustic speakers so as to form their emissions as best possible, thus optimizing the final acoustic result in terms of fidelity and quality. In order to achieve a satisfactory result, at least two planar acoustic transducers and two frequency sub-bands must be used, preferred embodiments include the use of two, three, four or five acoustic transducers and a corresponding number of frequency sub-bands.

A first example of application of the method according to the present invention is described below and uses three acoustic transducers and an equal number of frequency sub-bands and filters. Similarly, the method and apparatus illustrated in the example are applied to a different number of transducers, frequency sub-bands and filters, without departing from the scope of the present invention.

Firstly, the filters to be used are chosen. As the linear acoustic transducers have, in general, cutoff frequencies of 20-40 W and a frequency field from 50 Hz to 15 kHz, a first filter is used adapted to eliminate the ultra-low frequencies which could cause undesired vibrations in the planar transducers at loud operating volumes. For this purpose, the following filters can be used: for low frequencies, a first pass-band filter with lower cutoff frequency from 90 Hz to 120 Hz, a higher cutoff frequency from 3000 Hz to 4000 Hz and an attenuation, e.g. of 6, 12 or 24 dB/octave. For medium frequencies, a second pass-band filter is provided, having a higher cutoff frequency from 3500 Hz to 5000 Hz, a lower cutoff frequency about 800 Hz and an attenuation, e.g. of 3 or 6 dB/octave according to the material of which the surface on which the acoustic speakers are installed. Finally, for high frequencies, a third high-pass filter is provided, having a lower cutoff frequency about 8000 Hz and an attenuation, e.g. of 3 or 6 dB/octave according to the material of which the surface on which the acoustic speakers are installed. For example, a low attenuation is chosen in the case of plastic materials, such as PVC, attenuations of 3 or 6 dB/octave on the high frequencies are preferred in the case of multilayer materials, while attenuations of 3 dB/octave on the medium frequencies and attenuations of 3 or 6 dB/octave on the high frequencies are preferred in the case of very hard materials, such as marble or ceramic.

Later, the planar acoustic speakers are chosen; their number should correspond to the frequency bands chosen to divide the audio band with the filters above and of the type suited to the installation to be made. Finally, the speakers are installed on the available surface.

The first step to be performed is to divide the surface into as many zones as the acoustic speakers and the frequency bands identified by the employed filters.

A preferred division according to the present invention and shown in accompanying FIG. 1 includes identifying three zones 20, 21, 22, in which a first zone of area approximately equal to half of the surface available for the installation and a second and a third zone having area approximately equal to a fourth of said available surface.

The planar transducers are then connected to the previously chosen filters and each installed in one of the zones into which the surface available for the installation is divided.

The transducer 10 connected to said first low frequency filter is arranged in said first zone 20, the transducer 11 connected to said second filter and the transducer 12 connected to said third filter are each arranged in one of the other two zones 21, 22. Preferably, the transducer 11 connected to said second filter is arranged inside a second zone 21 adjacent to said first zone 20, while the transducer 12 connected to said third filter is arranged inside a third zone 22 adjacent to said second zone 21. Advantageously, in a preferred embodiment of the present invention shown in accompanying FIG. 1, the transducer is arranged connected to said first filter, approximately in the center of said first zone, while the transducer is arranged connected to said second filter and the transducer connected to said third filter, offset with respect to said second and third zone so as to increase the distance between them with respect to the minimum possible distance. Thereby, an optimal level of acoustic emission resulting from the combination of the emissions of the three single planar speakers is achieved.

More in detail, a first acoustic speaker 10, connected to the low frequency audio filter, substantially in central position with respect to the area of said first surface portion 20; a second acoustic speaker 11 is arranged, connected to the medium frequency audio filter, in offset position with respect to the area of said second surface portion 21, on a first side with respect to an axis 13 passing through said first acoustic speaker; a third acoustic speaker 12 is arranged, connected to the high frequency audio filter, in offset position with respect to the area of said third surface portion 22, on a second side, opposite to said first side with respect to said axis 13. The described arrangement of a plurality of planar acoustic speakers thus allows the combination of their acoustic emissions to be optimized by controlling the interferences and beats between them.

Figure 2:
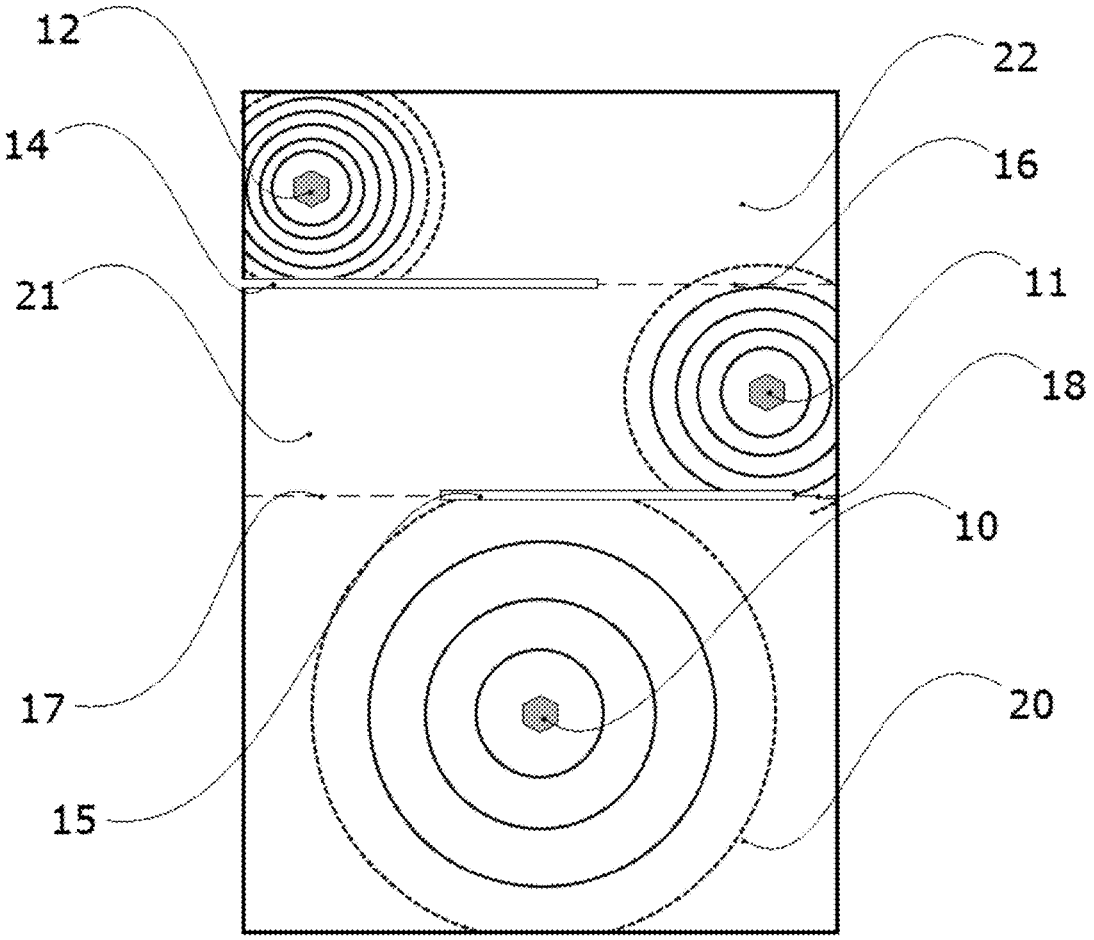
FIG. 2 shows a second preferred embodiment of the apparatus for playing audio according to the present invention.

According to an aspect of the present invention, a series of incisions can be made on said surface adapted to confine the emissions of each speaker in a limited area in order to increase the distinction and separation between the propagation of the acoustic emissions of the various planar acoustic speakers on the surface on which they are installed. Accompanying FIG. 2 shows a second preferred embodiment of the present invention which shows an example of said incisions. They are made in approximately equally spaced position from the two adjacent speakers and such to either attenuate or interrupt the incident surface acoustic waves emitted by the aforesaid speakers. Substantially, the aforesaid incisions have the effect of delimiting the emission propagation zones of each speaker, by limiting the communication zones between the various emissions of the various speakers and actually modulating the mixing between said emissions as a consequence.

A second preferred embodiment of the present invention is shown again with reference to FIG. 2 accompanying the present application, in which three speakers 10, 11, 12 are used on a surface on which two incisions 14, 15 are made, adapted to partially and mutually delimit the interaction zones of each speaker. The position and the extension of said incisions is such to delimit one of more interaction zones 16, 17, 18 between the speaker emissions, and thus favor a particular mixing between the various emissions of the employed speakers 10, 11, 12.

A choice criterion of the aforesaid incisions may be that according to which the size of interaction zones delimited by the cuts—approximately inversely proportional to the extension of said cuts—must be at least partially proportional to the amount of acoustic oscillations coming from two zones and from two different speakers, which must be mixed. A parallel may be established between the function of such interaction zones and the function of a proper filter, recognizing high attenuations, e.g. of 18 or 24 dB/octave, to the small-size interaction zones and low attenuations, e.g. of 3 or 6 dB/octave, to the large-size interaction zones.

Figure 3:
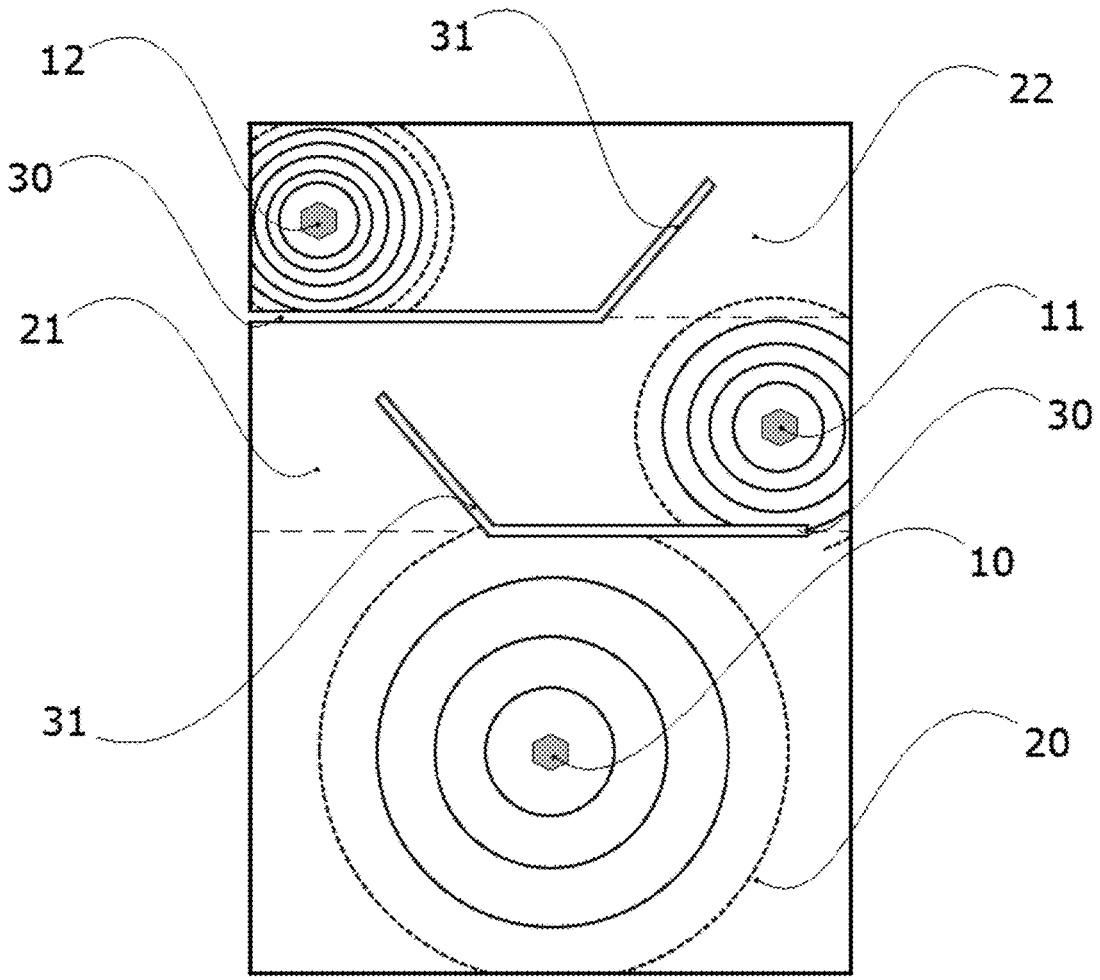
FIG. 3 shows a third preferred embodiment of the apparatus for playing audio according to the present invention.

Another choice criterion of the aforesaid incisions includes making incisions comprising two distinct stretches 30, 31, inclined with respect to each other, as shown in accompanying FIG. 3, which shows a third embodiment of the present invention. Thereby, an effect of separation between the wavelengths emitted by the two facing speakers which is composite and more gradual is obtained. Indeed, substantially, one incision has the cutoff power of the surface sound waves emitted by a speaker which is minimum when the incision is radial to the center of the speaker and maximum when the incision is perpendicular to the aforesaid radial direction. Thus, by using incisions comprising two distinct stretches 30, 31, inclined with respect to each other, there is a cutoff power of the propagation of the surface sound waves which is higher at a first stretch 30 and lower on the subsequent stretch 31.

Therefore, the inclination of the aforesaid incisions can be linked to the attenuation, in dB, that the surface sound propagation undergoes, said attenuation indeed increasing with the value of the angle between the incision and the radial direction with respect to the center of the speaker. Therefore, we may have incisions corresponding to attenuations of 6 dB, 12 dB etc.

Figure 4:
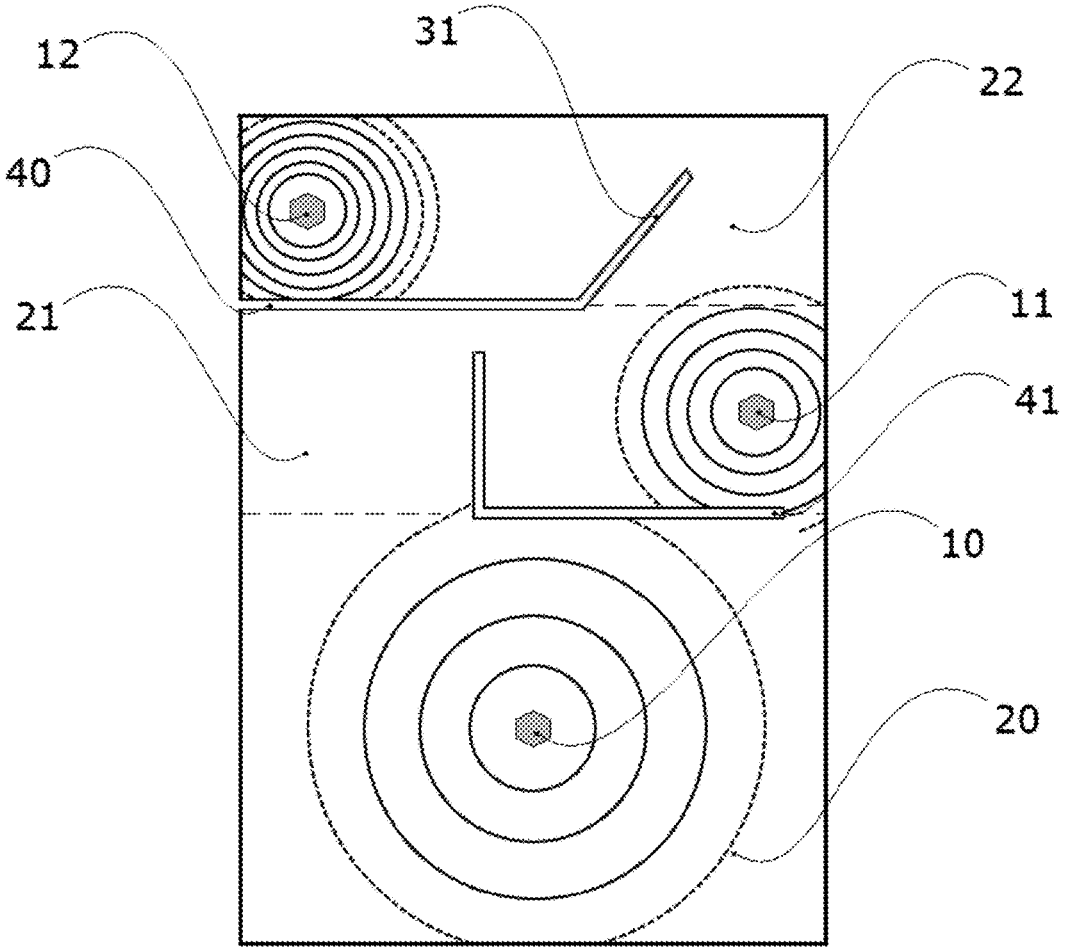
FIG. 4 shows a fourth preferred embodiment of the apparatus for playing audio according to the present invention.

Accompanying FIG. 4 shows a fourth preferred embodiment of the present invention in which the arrangement on the available plane of the speakers 10, 11, 12 and respective incisions 40, 41 is indicated for hard rock or heavy metal type music because it is adapted to attenuate the medium tones—reserving a limited surface to them—and to enhance bass and treble.

Figure 5:
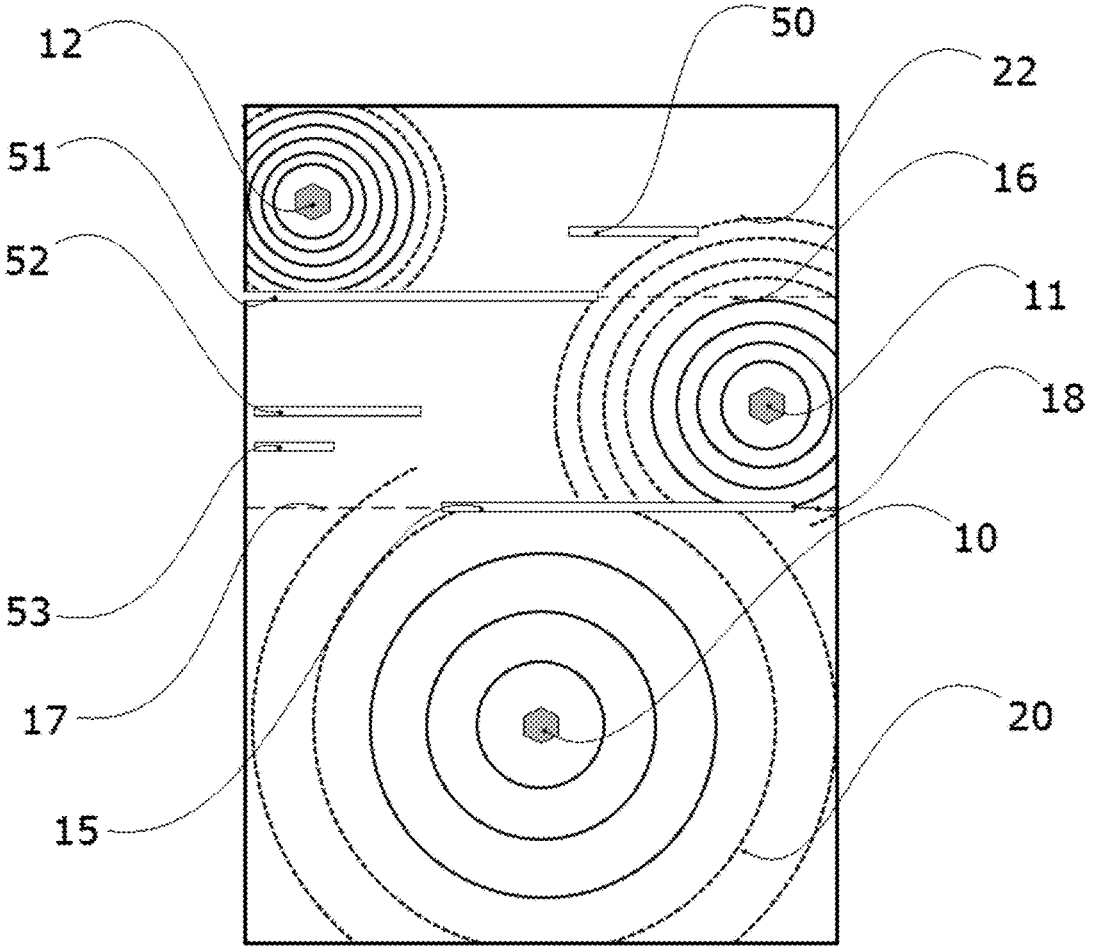
FIG. 5 shows a fifth preferred embodiment of the apparatus for playing audio according to the present invention.

Accompanying FIG. 5 shows a fifth embodiment of the present invention. The arrangement on the available plane of the speakers 10, 11, 12 and the respective incisions 50-54 is indicated so separate the speaker emissions and limit the overlapping and the beats between the various frequencies.

A further exemplary embodiment of the present invention includes the use of three separate, independent assembly panels, one for each employed speaker. In this case, the speakers are preferably arranged approximately in the center of each panel.

The invention claimed is:

1. A method for optimized music playing by means of planar acoustic transducers comprising:

supplying a first electric audio signal;

providing a plurality of planar acoustic speakers adapted to convert input electric audio signals into output acoustic signals;

providing a plurality of audio filters adapted to filter in frequency said first electric audio signal so as to output a second electric audio signal comprising a limited frequency band with respect to the frequency band of said first electric audio signal;

providing a surface adapted to house said plurality of planar acoustic speakers;

electrically connecting said first electric audio signal to the input of each of said audio filters of said plurality of audio filters and connecting the output of each of said audio filters to said plurality of audio filters at the input of an acoustic speaker of said plurality of acoustic speakers;

locating, on said surface, a plurality of surface portions of number equal to the number of said acoustic transducers so that the size of one of said surface portions is greater than the other surface portions, said plurality of surface portions comprising a first surface portion, a second surface portion adjacent to said first surface portion, a third surface portion adjacent to said second surface portion;

mechanically connecting said planar acoustic speakers to said surface, one for each of said surface portions, so that the larger size surface portion is associated with the acoustic speaker connected to the audio filter of said plurality of audio filters having the lowest frequency band, characterized in that said method further comprises:

arranging a first acoustic speaker, connected to the low frequency audio filter, substantially in central position with respect to the area of said first surface portion;

arranging a second acoustic speaker, connected to the medium frequency audio filter, in offset position with respect to the area of said second surface portion, on a first side with respect to a vertical symmetry axis passing through said first acoustic speaker; and arranging a third acoustic speaker, connected to the high frequency audio filter, in offset position with respect to the area of said third surface portion, on a second side, opposite to said first side with respect to said axis.

2. The method according to claim 1, characterized in that said plurality of audio filters comprises three audio filters, one of which dedicated to low frequencies, one dedicated to medium frequencies and one dedicated to high frequencies.

3. The method according to claim 1, characterized in that said plurality of surface portions comprises a first surface portion having an area equal to about half the area of said surface;

a second surface portion adjacent to said first surface portion and having an area equal to about one fourth of the area of said surface;

a third surface portion adjacent to said second surface portion and having an area equal to about one fourth of the area of said surface.

4. The method according to claim 1, characterized in that it comprises making at least one incision in said surface at the boundary between said first surface portion and said second surface portion and/or at the boundary between said second surface portion and said third surface portion.

5. The method according to claim 4, characterized in that said incisions are adapted to delimit one or more interaction zones between the acoustic emissions of said speakers.

6. The method according to claim 5, characterized in that said incisions comprise two distinct stretches, inclined with respect to each other.

7. An apparatus for optimized music playing by means of planar acoustic transducers comprising:

a first electric audio signal;

a plurality of planar acoustic speakers adapted to convert input electric audio signals into output acoustic signals;

a plurality of audio filters adapted to filter in frequency said first electric audio signal so as to output a second electric audio signal comprising a limited frequency band with respect to the frequency band of said first electric audio signal;

a surface adapted to house said plurality of planar acoustic speakers, wherein said first electric audio signal is connected to the input of each of said audio filters of said plurality of audio filters and the output of each of said audio filters of said plurality of audio filters is connected to the input of an acoustic speaker of said plurality of acoustic speakers;

on said surface a plurality of surface portions of number equal to the number of said acoustic transducers being located so that the size of one of said surface portions is greater than the other surface portions, said plurality of surface portions comprising a first surface portion, a second surface portion adjacent to said first surface portion, a third surface portion adjacent to said second surface portion;

said planar acoustic speakers being connected to said surface, one for each of said surface portions, so that the larger-size surface portion is associated with the acoustic speaker connected to the audio filter of said plurality of audio filters having the lowest frequency band characterized in that it further comprises:

a first acoustic speaker, connected to the low frequency audio filter, substantially in central position with respect to the area of said first surface portion;

a second acoustic speaker, connected to the medium frequency audio filter, in offset position with respect to the area of said second surface portion, on a first side with respect to a vertical symmetry axis passing through said first acoustic speaker; and a third acoustic speaker, connected to the high frequency audio filter, in offset position with respect to the area of said third surface portion, on a second side, opposite to said first side with respect to said axis.

8. The apparatus according to claim 7, characterized in that said plurality of audio filters comprises two audio filters, one of which dedicated to low frequencies, one dedicated to medium frequencies and one dedicated to high frequencies.

9. The apparatus according to claim 8, characterized in that said plurality of surface portions comprises a first surface portion having an area equal to about half the area of said surface;

a second surface portion adjacent to said first surface portion and having an area equal to about one fourth of the area of said surface;

a third surface portion adjacent to said second surface portion and having an area equal to about one fourth of the area of said surface.

10. The apparatus according to claim 8, characterized in that it comprises at least one incision made in said surface at the boundary between said first surface portion and said second surface portion and/or at the boundary between said second surface portion and said third surface portion.

11. The apparatus according to claim 10, characterized in that said incisions are adapted to delimit one or more interaction zones between the acoustic emissions of said speakers.

12. The apparatus according to claim 11, characterized in that said incisions comprise two distinct stretches, inclined with respect to each other.

* * * * *